US006598554B1

(12) United States Patent
Lasky et al.

(10) Patent No.: US 6,598,554 B1
(45) Date of Patent: Jul. 29, 2003

(54) SUBMARINE TOWED MEASURING SYSTEM

(75) Inventors: Marvin Lasky, Chevy Chase, MD (US); Lester F. Whicker, Rockville, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 04/394,390

(22) Filed: Aug. 31, 1964

(51) Int. Cl.[7] ..... B63G 8/14; B63G 8/22; B63G 21/04; B63G 21/56

(52) U.S. Cl. ..... 114/245; 114/253

(58) Field of Search ..... 114/235, 242, 114/244, 245, 253; 340/3 T, 6, 16

(56) References Cited

U.S. PATENT DOCUMENTS 3,125,980 A * 3/1964 Anderson

* cited by examiner

*Primary Examiner*—Charles T. Jordan
(74) *Attorney, Agent, or Firm*—John J. Karasek; Dorothy I. Becker

(57) ABSTRACT

A towed vehicle for positioning a towed device about a submarine, comprising:

(a) a housing having a wing for providing lift when said housing is towed through water;

(b) means coupled between said submarine and said housing for towing said housing; and (c) means coupled to said housing for varying the relative positions between the center of buoyancy and the center of gravity of said housing to dispose said wing in a given position.

11 Claims, 2 Drawing Sheets

SUBMARINE TOWED MEASURING SYSTEM

This invention relates to a towed device and more specifically to an improved instrument positioning device for use with a ship or submarine while cruising in water.

The continually increasing sophistication in the Naval Sciences includes the more efficient detection of submarines. A form of passive submarine detection is one in which an operator listens on a passive acoustical receiver for sound generated by a submarine at distances remote from the listener. Modern equipment provides a trained observer with means to measure noise from or detect ships and submarines by their characteristic self-generated noise patterns. Therefore, one means of prevention of detection of submarines is to know what sounds are generated thereon, thus, providing a more quiet ship.

Means of measuring generated sound of submarines includes such techniques as operating the ship near a fixed acoustical array and measuring the sound produced, but certain inherent problems exist with this system. For instance, it is difficult to operate a submarine under water near such an array without seriously endangering life and the equipment on the submarine.

It is therefore, an object of this invention to provide an improved towed apparatus for positioning devices measuring sound generated by a vehicle in water.

It is a further object of this invention to provide an improved device to tow sound receiving apparatus by a submarine for measuring near-sound noise generation of the submarine which may be analyzed.

It is yet a further object of this invention to provide a towed device for towing a transducer for sound detection which is spaced from and has its position controllable by the towing ship.

Yet another object of this invention is to provide a towed vehicle positionable in the water with respect to the towing vehicle having a variable relationship between the center buoyancy and its center of gravity.

Still a further object is to provide a towed vehicle having planer surfaces which selects a position with respect to its towing vehicle that is determined by the length of the towing cable, the amount of lift in its planer surfaces, and the relationship between the center of gravity and the center of buoyancy which predetermines the angle of attack of the planer surfaces.

It is still a further object of this invention to provide a towed vehicle for positioning the hydrophone array about a submarine, comprising, a housing having a wing for providing lift when the housing is towed through water, means coupled between the submarine and housing for towing the housing, and means within the housing for varying the relative position between the center of buoyancy and the center of gravity of the housing to dispose the wing in a given position.

And yet another object of this invention is to provide a vehicle of the type described wherein the buoyancy is controllable between a net positive and a net negative buoyancy.

It is to be understood that this invention is applicable to many situations wherein it is desirable to make underwater observations and measurements. For instance, the positionable device is discussed in this application as towing a hydrophone array for measuring near field noise generated by a submarine. The device maybe used equally well to support a television camera and lights for observations of the bottom of the ocean. Another use could be towing thermocouples for temperature measurements, magnetometers, nuclear sensing devices, decoys containing noise generators and the like.

Other objects, advantages and novel features of the invention will become apparent from the following detailed description of the invention when considered in conjunction with the accompanying drawings wherein.

Figure 1:
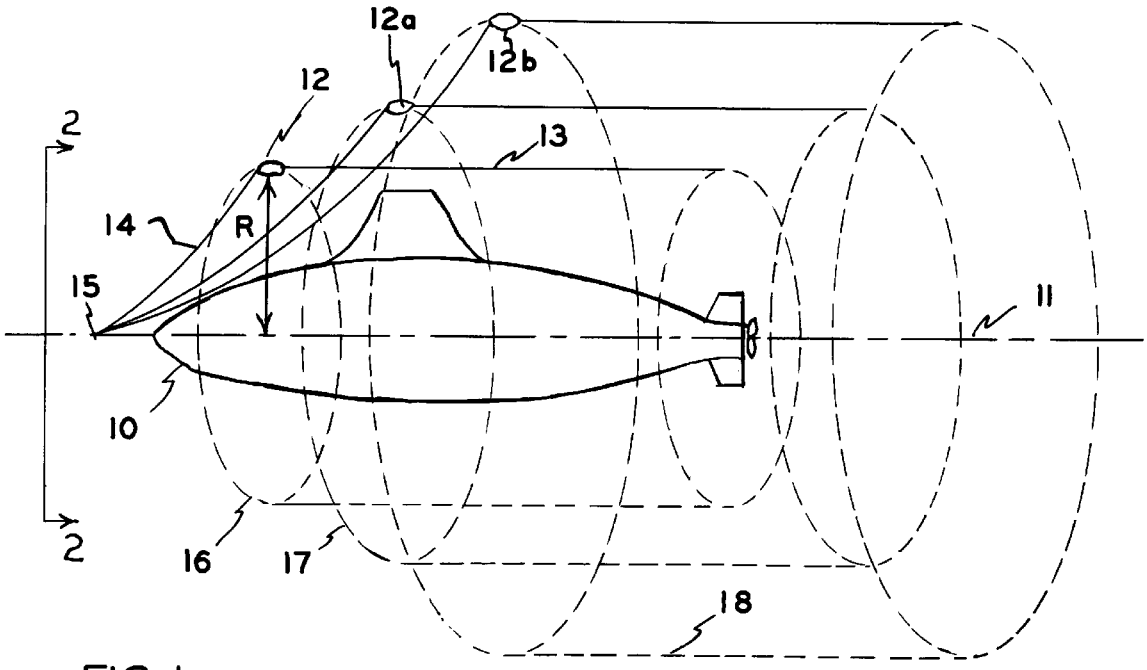
FIG. 1 is a schematic representation of the towed device attached to a submarine.
Figure 2:
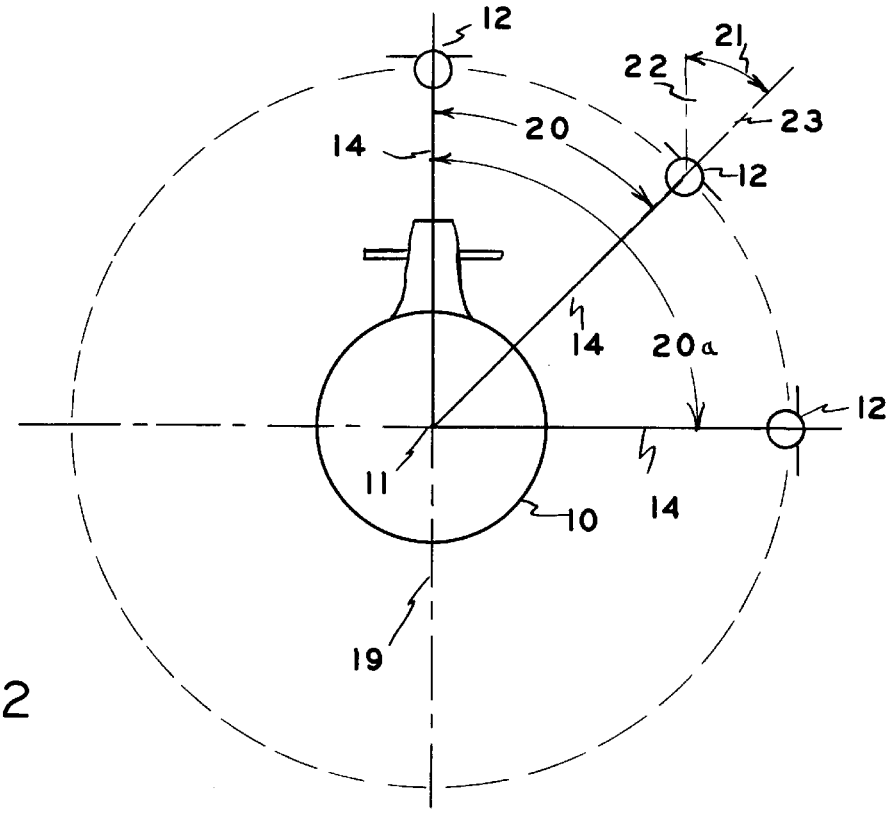
FIG. 2 is a view along lines 2—2 in FIG. 1.

The submarine 10 shown in FIGS. 1 and 2 is represented as proceeding, submerged, along a line of cruising 11. A towed vehicle or array positioning platform 12 has attached thereto a flexible line 13, having neutral buoyancy preferably, containing a plurality or array of spaced hydrophones. A towing cable 14 attached to vehicle 12 is affixed in a suitable manner at a point 15 on the bow of submarine 10. Towing cable 14 is faired to provide minimum drag and is selected consistent with that need modified by the strength requirements necessary for high speed towing. Further provision must be made for conductors within cable 14 for transmitting hydrophone signals. An example of a suitable cable is one made of steel, double armored and having a diameter of 0.4 inches. Such a cable will accommodate 8 to 10 conductors, has a breaking strength of 13,000 lbs tensile, and an estimated drag coefficient of 0.3. The safety factor in use at any particular time will determine the maximum allowable tension to be imposed on the cable and may be computed for various speeds and other conditions.

As shown in FIG. 1 there are a number of possible positions of towed vehicle 12, indicated at 12*a* and 12*b*. Depending upon the length of cable 14, the speed of submarine 10 and the factors described hereinafter more fully, the towed vehicle 12 will position itself some distance R from line of travel 11 of submarine 10. Flexible line 13 will be pulled along by towed vehicle 12 substantially parallel to the line of submarine travel.

As the submarine is underway it will generate noise due to such items as the turning screws, water friction on the hull, internal machinery, etc. This noise is radiated in all directions from the submarine and by utilizing the invention it is possible to detect the noise by the hydrophone array of line 13. By positioning towed vehicle 12 in positions 12*a* and 12*b*, for example, and in other radial positions the near-noise field generated by submarine 10 can be determined and the causally related far-noise field mathematically and statistically evolved. Information of this nature, once available, is the first step towards possible elimination or diminuition of a portion, at least, of a submarine's self-noise. The three representative concentric cylindrical, sections 16, 17, and 18 represent the possible positions of the hydrophone as hereinafter more fully explained.

Referring to FIG. 2 towed vehicle 12 is shown in three possible radial positions, and cable 14 is shown making angles 20 and 20*a* with the vertical axis 19. Angle 21 between a vertical line 22 and line 23 (an extension of cable 14) is equal to the angle 20, under normal operating conditions. Thus, when in operation, sensing angle 21 and telemetering this information to an observer on the submarine will indicate the towed vehicle's position with respect to the submarine when considered along with cable length and submarine speed. Therefore, it is possible by use of the present invention to regulate and control the position of vehicle 12 relative to submarine 10 by varying the speed, the cable length, and the towed vehicle attitude; this, of course, determines the position of flexible line 13 and the hydrophone array relative to the submarine. Additionally, the system permits the hydrophone array to align itself parallel to the longitudinal axis of the submarine at whatever radial angle vehicle 12 is disposed. Such parallel disposition of the array is important to the facilitated analysis of the acquired data.

Figure 3:
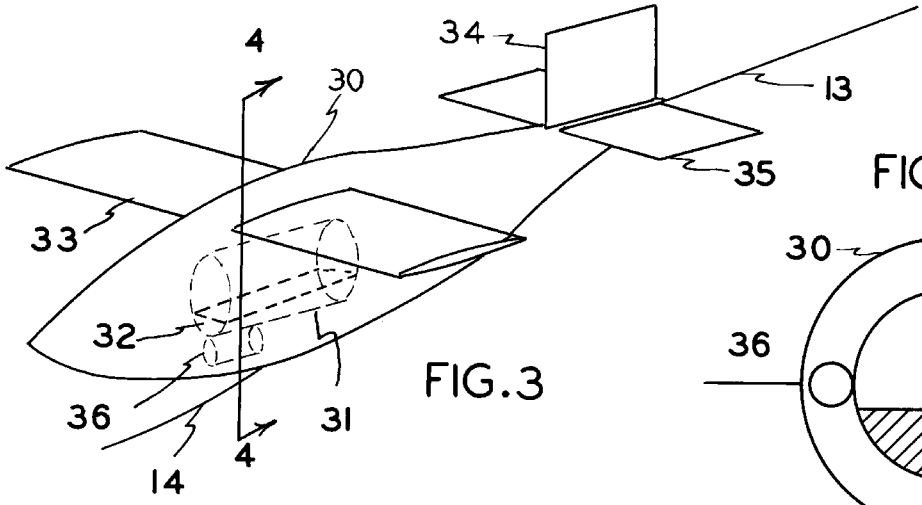
FIG. 3 is a schematic presentation of the towed vehicle.
Figure 5:
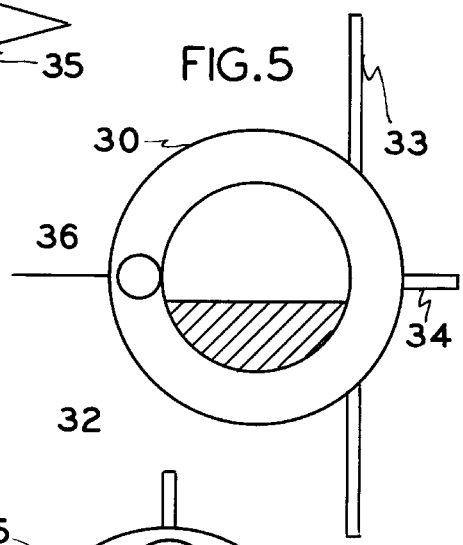
FIG. 5 is a second view along lines 4—4 in FIG. 3.
Figure 4:
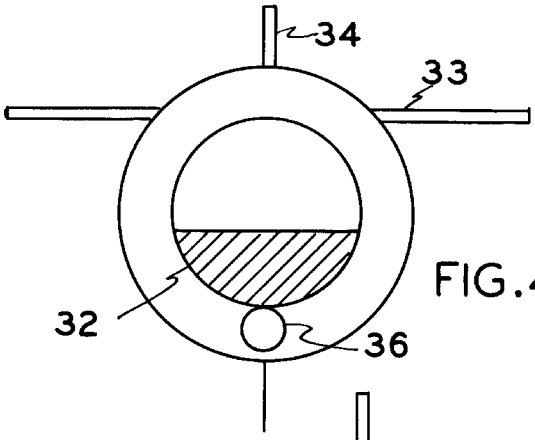
FIG. 4 is a sectional view along lines 4—4 in FIG. 3.

The following description relates to the means employed for controlling the attitude of vehicle 12. FIG. 3 shows one schematic construction of a towed vehicle 30, capable of accomplishing the positioning of flexible cable 13. For the purposes of this discussion the towed vehicle is shown having a cylindrical adjustable ballast member 31 shown in dotted configuration. As shown in FIGS. 3, 4, and 5 member 31 has an eccentric weight 32 occupying a portion of the volume. Vehicle 30 includes a wing 33, rudder 34 and stabilizers 35. Although not shown it is to be understood that there are the usual control surfaces on each of these items to aid in properly regulating the attitude of vehicle 30 while in operation.

It is noted that in positioning an array around a submarine, roll stability and lateral control are the major difficulties. Hydrodynamic devices (wings, rudders, trim tabs, etc.) are available to produce stability in pitch and yaw, but purely hydroynamic means of producing roll restoring moments are not available. A degree of roll stability may be attained in the vertical plane by providing the towed vehicle positive buoyancy (directly above the submarine) or negative buoyancy (directly below the submarine), but in positions other than the vertical, restoring moments would tend to return the towed vehicle to the vertical. However, in a neutrally buoyant towed vehicle a high degree of roll or metacentric stability may be provided by varying the relative positions of the vehicle's centers of gravity and buoyancy. To this end, as shown in FIGS. 4 and 5, schematically, a motor 36 is provided to rotate ballast member 31 so that eccentric weight 32 may be shifted in position with respect to the various control surfaces. Since the shifting of weight 32 results in a shifting of the center of gravity a turning moment is developed resulting in a roll and consequent change in attitude of vehicle 30. Therefore, depending on the speed with which vehicle 30 is towed by the submarine, fluid impinging on the hydrodynamic surfaces of vehicle 30 will result in producing force components whose magnitude and direction will depend on the attitude or orientation of these surfaces to the direction of travel. Thus, by varying submarine speed, cable scope and length and vehicle attitude, vehicle 30 may be positioned anywhere about the submarine, both radially and longitudinally, while carrying the hydrophone array at all times parallel to the longitudinal axis thereof.

Figure 6:
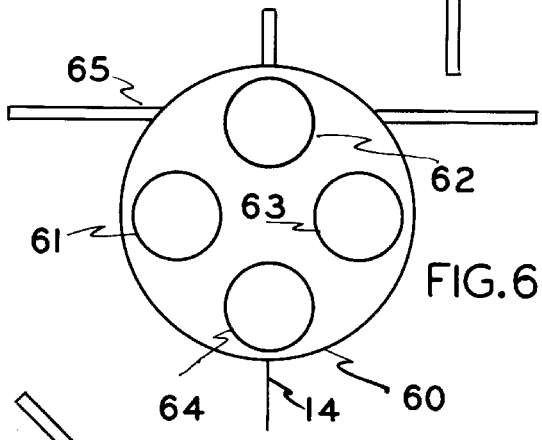
FIGS. 6, 7 and 8 show a second embodiment of the towed vehicle utilizable with this invention.
Figure 7:
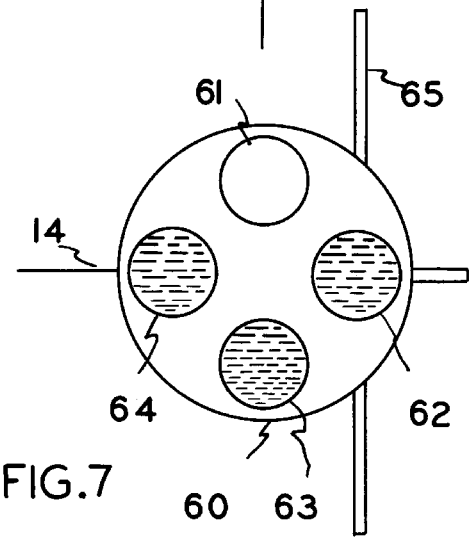
Figure 8:
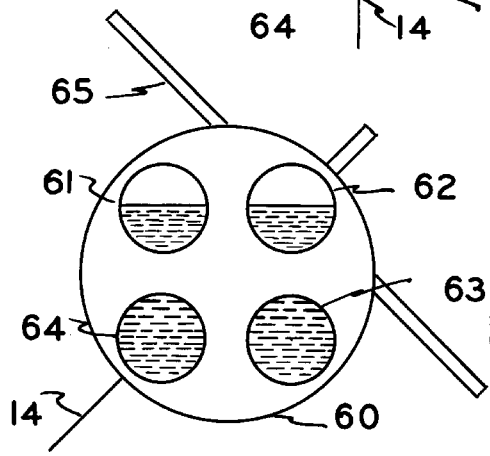

The towed vehicle 60 of FIGS. 6, 7, and 8 provides for shifting the relative positions of the center of buoyancy and the center of gravity in a different manner. There is provided a plurality (preferably four) ballast tanks, 61, 62, 63, and 64. As in the previous embodiment, a wing 65 and towing cable 14 are provided. In FIG. 6 all four tanks 61, 62, 63, 64 are shown empty, i.e., filled with air, and vehicle 60 which is designed, preferably, to be neutrally buoyant when three of the tanks are filled with water, will have a net positive buoyancy. This condition will cause vehicle 60 to rise and position cable 14 vertically above the submarine. Vehicle 60 will maintain the array as shown in FIG. 1 by flexible line 13.

FIG. 7 shows three of the tanks 62, 63, and 64 filled with water while tank 61 is empty. Filling this combination of tanks will cause a rolling moment and vehicle 60 will assume the position as shown with wings 65 vertically aligned. Towed in this attitude hydrodynamic forces will cause vehicle 60 to assume a position (relative to the submarine) 90 degrees from the vertical as shown in FIG. 2.

FIG. 8 shows vehicle 60 in an attitude of 45 degrees from the vertical. This was accomplished by filling tanks 63, 64 and partially filling tanks 61, 62. Hydrodynamic forces operating on wings 65 as vehicle 60 is pulled through the water will cause the vehicle to "travel" to a position (relative to the submarine) determined by these forces. Thus, vehicle 60 may be radially positioned anywhere about the submarine by varying the ballast tank combinations.

Suitable controls may be provided in the towed body for actuating the valving of the tanks on signal from an operator on the submarine. As indicated previously, cable 14 is faired and can accommodate, preferably, a plurality of conductors whereby the towed body or vehicle may be controlled from within the submarine.

Obviously, many modifications and variations of the present invention are possible in the light of the above teachings. It is therefore to be understood that within the scope of the appended claims the invention may be practiced otherwise than as specifically described.

We claim:

1. A towed vehicle for positioning a towed device about a submarine, comprising:

(a) a housing having a wing for providing lift when said housing is towed through water;

(b) means coupled between said submarine and said housing for towing said housing; and (c) means coupled to said housing for varying the relative positons between the center of buoyancy and the center of gravity of said housing to dispose said wing in a given position.

2. The vehicle of claim 1, wherein said housing is substantially neutrally buoyant.

3. The vehicle of claim 1, wherein means are provided to vary the buoyancy of said housing between a net positive buoyancy and a net negative buoyancy.

4. The vehicle of claim 3, wherein means are provided in said submarine to control the relative position of said centers.

5. The vehicle of claim 4, wherein means are provided in said submarine for controlling said buoyancy of said housing.

6. The vehicle of claim 5, wherein means are provided in said coupling means for interconnecting said control means to said housing.

7. A towed vehicle for positioning a sensing device about a submarine, comprising:

(a) a rotatable housing having a center of rotation and having a wing for providing lift when said housing is towed through water;

(b) means coupled between said submarine and said housing for towing said housing; and (c) means within said housing for varying the relative position between the center of buoyancy and center of gravity of said housing to rotate said housing and said wing into a given position with respect to the center of rotation.

8. A towed vehicle positioning a hydrophone array about a submarine, comprising:

(a) a housing having a longitudinal axis and having a wing for providing lift when said housing is towed along said longitudinal axis in water;

(b) means, including a towing cable connecting said housing to said submarine, for towing said housing in a direction along said axis; and (c) means within said housing and positionable about said axis for varying the relative positions of the center of buoyancy and center of gravity of said housing to dispose said wing in a given position.

9. A towed vehicle for positioning a hydrophone array about a submarine, comprising:

(a) a housing having a longitudinal axis and having a wing for providing lift when said housing is towed along said longitudinal axis in water;

(b) means, including a towing cable connecting said housing to said submarine, for towing said housing in a direction along said axis; and (c) means, including a member having an eccentric weight rotatable about said axis within said housing, for varying the relative positions of the center of buoyancy and center of gravity of said housing to dispose said wing in a given position.

10. A towed vehicle for positioning a hydrophone array about a submarine, comprising:

(a) a housing having a longitudinal axis and having a wing for providing lift when said housing is towed along said longitudinal axis in water;

(b) means, including a towing cable connecting said housing to said submarine, for towing said housing in a direction along said axis; and (c) means, including a plurality of ballast tanks capable of individually being emptyed or filled for varying the relative positions of the center of buoyancy and center of gravity of said housing to dispose said wing in a given position.

11. A towed vehicle for positioning a hydrophone array about a submarine, comprising:

(a) towing means connecting said submarine and vehicle;

(b) means on said vehicle for generating hydrodynamic forces as the vehicle is pulled through water; and (c) means for selectively controlling the attitude of said vehicle whereby the hydrophone array may be positioned substantially parallel to the axis of the submarine at any radial position of the vehicle about the submarine.

* * * * *

UNITED STATES PATENT AND TRADEMARK OFFICE

CERTIFICATE OF CORRECTION

PATENT NO. : 6,598,554 B1
DATED : July 29, 2003
INVENTOR(S) : Lasky et al.

It is certified that error appears in the above-identified patent and that said Letters Patent is hereby corrected as shown below:

Title page,
Item [57], ABSTRACT, the current abstract should be replaced with -- This instant invention is a device towed by a submarine for measuring the sound generated by the submarine in the water. The towed vehicle has planer surfaces which select a position with respect to the towing vehicle or submarine which is determined by the length of the towing cable and the amount of lift on its planer surfaces. The towed vehicle positions a hydrophone array about the submarine for measuring near field noise generated by the submarine. --

Signed and Sealed this

Twenty-ninth Day of June, 2004

JON W. DUDAS
*Acting Director of the United States Patent and Trademark Office*